US006652925B1

(12) United States Patent
Schwarz et al.

(10) Patent No.: US 6,652,925 B1
(45) Date of Patent: Nov. 25, 2003

(54) METHOD FOR PRODUCING MASSIVE-AMORPHOUS LAYERS ON MASSIVE METALLIC SHAPED BODIES

(75) Inventors: Wolfgang Schwarz, Dresden (DE); Jürgen Eckert, Dresden (DE); Sabine Schinnerling, Dresden (DE)

(73) Assignee: Institut für Festkörper- und Werkstofforschung Dresden e.V., Dresden (DE)

( * ) Notice: Subject to any disclaimer, the term of this patent is extended or adjusted under 35 U.S.C. 154(b) by 0 days.

(21) Appl. No.: 10/070,488

(22) PCT Filed: Sep. 1, 2000

(86) PCT No.: PCT/DE00/03036

§ 371 (c)(1),
(2), (4) Date: Mar. 1, 2002

(87) PCT Pub. No.: WO01/16392

PCT Pub. Date: Mar. 8, 2001

(30) Foreign Application Priority Data

Sep. 2, 1999 (DE) ..... 199 42 161
May 25, 2000 (DE) ..... 100 27 645

(51) Int. Cl.[7] ..... B05D 3/00; B05D 3/06; B05D 1/36

(52) U.S. Cl. ..... 427/595; 427/535; 427/551; 427/554; 427/576; 427/596; 427/597; 427/405

(58) Field of Search ..... 427/535, 551, 427/554, 555, 576, 595, 596, 597, 405; 148/403, 512, 561

(56) References Cited

U.S. PATENT DOCUMENTS 4,834,806 A * 5/1989 Hashimoto et al. ..... 428/680
4,915,980 A * 4/1990 Matsunawa et al. ..... 427/556
5,143,533 A 9/1992 Brusasco

FOREIGN PATENT DOCUMENTS

DE 38 00 454 7/1989
JP 63-085187 10/1989

OTHER PUBLICATIONS

Patent Abstracts of Japan, vol. 013, NR. 111, C–577, Mar. 16, 1989.

* cited by examiner

*Primary Examiner*—Michael Barr
(74) *Attorney, Agent, or Firm*—Collard & Roe, P.C.

(57) ABSTRACT

The aim of the invention is to develop a method for producing massive-amorphous layers on massive metallic shaped bodies. According to the method, amorphous layers having a thickness of >20 μm can be produced in only one procedure step. To this end, alloys which can be used for producing massive metallic glasses under quick solidification conditions or alloy elements which can be used for producing massive metallic glasses together with the elements of the shaped body material and under quick solidification conditions are molten by means of high-energy radiation are directly applied onto the massive metallic shaped body for producing an amorphous layer that is >20 μm up to several millimeter thick or are alloyed into the surface of the shaped bodies. The melt is quickly solidified by means of natural cooling and/or forced air cooling of the shaped body. The inventive method enables to coat metallic shaped bodies with massive metallic glasses which improve the surface characteristics. Such layers can be sued for increasing the anticorrosion or wear and tear properties of shaped bodies for instance.

10 Claims, 1 Drawing Sheet

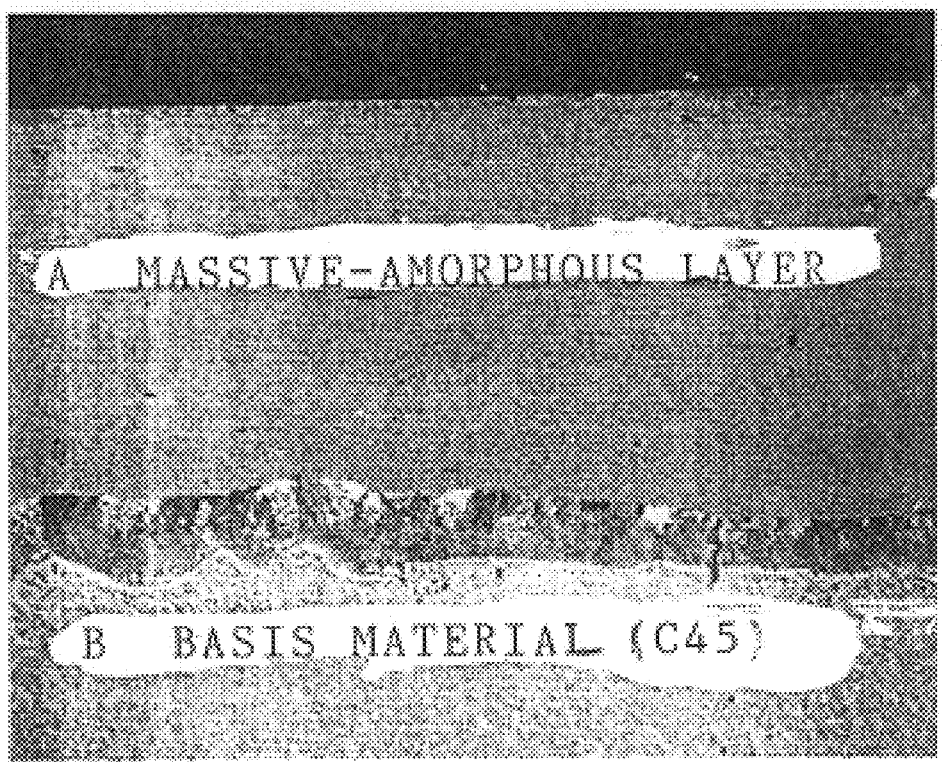
A MASSIVE-AMORPHOUS LAYER
B BASIS MATERIAL (C45)

METHOD FOR PRODUCING MASSIVE-AMORPHOUS LAYERS ON MASSIVE METALLIC SHAPED BODIES

CROSS REFERENCE TO RELATED APPLICATIONS

Applicants claim priority under 35 U.S.C. §119 of German Application Nos. 199 42 161.7, filed on Sep. 2, 1999 and 100 27 645.8, filed on May 25, 2000. Applicants also claim priority under 35 U.S.C. 371 of PCT/DE00/03036, filed on Sep. 1, 2000. The international application under PCT article 21 (2) was not published in English.

TECHNICAL FIELD

The invention relates to a method for producing massive-amorphous layers on massive metallic shaped bodies. It is possible with the method to coat metallic shaped bodies with massive metallic glasses that effect an improvement of the surface properties. Such layers may serve, for example for increasing the resistance of the shaped bodies to corrosion or wear.

STATE OF THE ART

It is known already to remelt shaped bodies consisting of massive-amorphous alloying systems on the surface by means of an electron or laser beam by the zone-melting process in order to obtain a massive-amorphous layer. However, the good properties of such layers can be exploited only inadequately because of the highly brittle crystalline basic bodies.

Furthermore, a method is already known for producing layers protecting against corrosion and wear as well as shaped bodies made from metallic amorphous materials, using a binary alloying system (DE 38 00 454 A1). In said process, an amorphous powder that can be processed further powder-metallurgically is produced first from crystalline starting substances by mechanical alloying. Said powder is subsequently applied to a substrate or compressed to a shaped body as the amorphous layer at an average temperature that is below the crystallization temperature. The drawback here is that when this technology is employed, the powder has to be produced in an expensive grinding process with a grinding time of approximately 20 hours. Furthermore, the amorphous surface layers so obtained are only-more or less mechanically clamped to or geared with the substrate.

It is known, furthermore, to deposit on a basic body one or more layers of metal or alloy to be rendered amorphous by first using conventional coating methods, for example by coating the basic body with a metal or alloy powder or by galvanic deposition. Said layers are subsequently melted onto the basic body by means of laser radiation or other high-energy radiation (JP 63-085187; U.S. Pat. No. 5,143,533; JP 63-286586). Amorphous thin films and layers can be obtained in this way with as thickness of up to 20 $\mu$m. Such films and layers, however, are too thin for many industrial application cases.

REPRESENTATION OF THE INVENTION

The invention is based on the problem of developing a method for producing massive-amorphous layers on massive metallic shaped bodies, by which amorphous layers with a thickness of >20 $\mu$m can be produced in only one single step of the production process.

Said problem is solved according to the invention with the method specified in the patent claims.

According to the invention, alloys that are suitable under rapid solidification conditions for forming massive metallic glasses, or alloying elements that are suited under rapid solidification conditions for forming jointly with the elements of the material of the shaped body massive metallic glasses, are transformed into the liquid melted state and then directly applied to the massive metallic shaped bodies for producing an amorphous layer with a thickness ranging from >20 $\mu$m up to a few millimeters, or they are alloyed into the surface of the shaped bodies. The rapid solidification of the melt is produced in this connection with the application of natural cooling of the shaped body and/or external cooling of the shaped body.

The method as defined by the invention permits in an advantageous manner the production of massive-amorphous layers with a thickness in the range of from >20 $\mu$m up to about 2 millimeters on massive metallic shaped bodies in only one single step of the production process. This makes it possible to produce functional layers, which, after a possible surface treatment, still readily have a minimum thickness in the range of a few tenths of a millimeter.

For the variation of application of alloys forming under rapid solidification conditions massive metallic glasses it is possible to employ Mg—, Zr—, Ti—, Fe—, Co—, Al—, Pd—, or Ni-based alloys.

It is possible to preferably use in this connection alloys selected from the groups formed by Zr—Ti—Al—Cu—Ni; Pd—Cu-Si; Pd—Ni—P; Zr—Cu—Ni—Al; Zr—M—Al—Ni—Cu(M=Ti, Nb, Pd); Fe—(Al, Ga); (Fe, Co)-(Zr, Hf, Nb, Ln)—B; and La-Al—Ni—Cu.

For the variation of alloying into the surface alloying elements that, together with the elements of the material of the shaped body can be used under rapid solidification conditions for forming massive metallic glasses, it is possible to employ those elements that together with the elements of the material of the shaped body result in a massive amorphous Mg—, Zr—, Ti—, Fe—, Co—, Al—, Pd— or Ni-based alloy.

Those elements can be preferably used that together with the elements of the material of the shaped body form an alloy of the groups of Zr—Ti—Al—Cu—Ni; Pd—Cu—Si; Pd—Ni—P; Zr—Cu—Ni—Al; Zr—M—Al—Ni—Cu(M=Ti, Nb, Pd); Fe—(Al, Ga); (Fe, Co)-(Zr, Hf, Nb, Ln)-B; and La-Al—Ni—Cu.

Electron beams, laser beams and/or a plasma can be employed as the high-energy radiation. The electron beam method offers good preconditions for this purpose because of the vacuum in the work recipients for processing alloys with high affinity to oxygen, and it is therefore specially suited for the zirconium alloys.

The material to be applied or alloyed into the surface is used in the form of a foil, a strip, a wire; in the form of powder or in the form of a filling wire or filling strip. It is advantageous if the material to be applied or alloyed into the surface is used in the form of an amorphous foil than can be reeled.

It is possible according to the invention to apply to or alloy into the surface a plurality of layers disposed one next the other. The width of the layer, which can be produced in one work step of the process, is dependent upon the width of the foil to be processed, and on the capacity of the available electron beam generation equipment.

The massive-amorphous layer so produced can be remelted by means of high-energy radiation for the purpose of homogenization and for eliminating any crystalline zones that may still be present in the layer.

BEST APPROACHES FOR IMPLEMENTING THE METHOD

The method is explained in the following in greater detail with the help of examples of execution of the method of the invention and an associated drawing showing a section through a shaped body coated as defined by the invention.

EXAMPLE 1

A massive-amorphous layer is applied to a steel grade C45 by means of the electron beam coating method. For this purpose, an amorphous foil consisting of a Zr-based alloy with a thickness of 50 $\mu$m and a width of 10 mm is used. Said foil contains 65 mass-% Zr, 25.5 mass-% Cu, 3.9 mass-% Ni, and 3.6 mass-% Al, and had been produced using the classical melt spinning method.

The foil is supplied by means of a foil feeding device at a very high feeding rate of up to 20 cm/s to an electron beam whose area energy amounts to about 2000 $Ws/cm^{-2}$, whereby the field of energy is subdivided in a preheating field and a melting field.

So that an adequate cooling rate of the layer can still be obtained for an amorphous solidification, the thickness of the layer is limited for said alloy to 0.5 mm.

In the course of application of the layer it is necessary to make sure that no mixing with the basic material will occur because this may otherwise result in an alteration of the chemical composition of the material of the foil, and as a consequence thereof may cause crystalline solidification of the layer.

The shaped body coated with an amorphous layer with a thickness of about 0.5 mm shown in the drawing is obtained as the result of the method.

EXAMPLE 2

The present example is based on the same materials and technological equipment as used in example 1, whereby, however, a plurality of application traces of the amorphous coating material are applied to the shaped body next to each other.

Crystallization occurs in this connection in a narrow zone of overlap. For eliminating such crystallization, the applied layer is again remelted and homogenized on electron beam generation equipment without influencing the basic material, so that a massive-amorphous coating is subsequently obtained.

What is claimed is:

1. A method for producing amorphous layers on metallic shaped bodies, comprising providing alloys suited for forming metallic glasses under solidification conditions, or alloying elements suited for forming metallic glasses under solidification conditions jointly with the elements of the material of the shaped body, and applying said alloys or elements in the molten form directly to the metallic shaped body by means of radiation for producing an amorphous layer with a thickness of >20 $\mu$m or alloyed into the surface of the shaped bodies, and produce solidification of the melt by means of natural cooling of the shaped body and/or external cooling of the shaped body.

2. The method according to claim 1, wherein a suitable Mg—, Zr—, Ti—, Fe—, Co—,Al—, Pd— or Ni-based alloy is used for applying the melt for forming metallic glasses under solidification conditions.

3. The method according to claim 2, wherein one or more alloys suited for forming metallic glasses under solidification condition are selected from the group consisting of alloys formed by Zr—Ti—Al—Cu—Ni; Pd—Cu—Si; Pd—Ni—P; Zr—Cu—Ni—Al; Zr—M—Al—Ni—Cu (M=Ti, Nb, Pd); Fe—(Al, Ga); (Fe, Co)—(Zr, Hf, Nb, Ln)—B; and La-Al—Ni—Cu are used.

4. The method according to claim 1, wherein those elements are used for alloying into the surface that jointly with the elements of the materials of the shaped bodies result in the formation of amorphous Mg—, Zr—, Ti—, Fe—, Co—, Al—, Pd— or Ni-based alloys suitable for forming metallic glasses under solidification conditions.

5. The method according to claim 4, wherein those elements are used for alloying into the surface that jointly with the elements of the materials of the shaped bodies form alloys selected from the group consisting of Zr—Ti—Al—Cu—Ni; Pd—Cu—Si; Pd—Ni—P; Zr—Cu—Ni—Al; Zr—M—Al—Ni—Cu (M=Ti, Nb, Pd); Fe—(Al, Ga); (Fe, Co)—Zr, Hf, Nb, Ln)—B; and La-Al—Ni—Cu suited for forming one or more alloys suitable for forming metallic glasses under solidification conditions.

6. The method according to claim 1, wherein electron beams, laser beams and/or a plasma are used as the radiation.

7. The method according to claim 1, wherein the material to be applied or alloyed into the surface is employed in the form of a foil, a strip, a wire, in the form of powder or in the form of a filling wire or filling strip.

8. The method according to claim 7, wherein the material to be applied or alloyed in is used as a amorphous foil that can be reeled.

9. The method according to claim 1, wherein the resulting amorphous layer is remelted by means of radiation for the purpose of homogenization and for eliminating any crystalline zones that may still be present in the layer.

10. The method according to claim 1, wherein several layers disposed one next to the other are applied or alloyed into the surface; and that said layers are subsequently jointly remelted by means of radiation for the purpose of homogenization and for eliminating any crystalline zone that may still be present in the layers.

* * * * *